US008061093B2

(12) United States Patent
Cashman

(10) Patent No.: US 8,061,093 B2
(45) Date of Patent: Nov. 22, 2011

(54) WINDOW FRAME WITH INSTALLATION HOOKS

(76) Inventor: Daniel J. Cashman, Suffield, CT (US)

( * ) Notice: Subject to any disclaimer, the term of this patent is extended or adjusted under 35 U.S.C. 154(b) by 321 days.

(21) Appl. No.: 12/152,107

(22) Filed: May 12, 2008

(65) Prior Publication Data

US 2009/0277107 A1 Nov. 12, 2009

(51) Int. Cl.
*E06B 1/04* (2006.01)

(52) U.S. Cl. ..... 52/213; 52/656.1; 52/204.1; 52/204.55

(58) Field of Classification Search ..... 52/204.2, 52/204.1, 210, 211, 204.52, 204.53, 204.55, 52/204.59, 213, 656.1, 208; 49/388
See application file for complete search history.

(56) References Cited

U.S. PATENT DOCUMENTS 1,863,549 A * 6/1932 Lockwood ..... 264/35
3,975,875 A * 8/1976 Goss, Jr. ..... 52/204.53
3,994,470 A * 11/1976 Nakada ..... 249/93
4,430,831 A * 2/1984 Kemp ..... 52/204.53
5,169,544 A * 12/1992 Stanfill et al. ..... 249/22
5,746,033 A * 5/1998 Chuang ..... 52/213
6,298,631 B1 * 10/2001 Finley ..... 52/742.15
6,922,958 B2 * 8/2005 Derderian ..... 52/204.55

* cited by examiner

*Primary Examiner* — Eileen D Lillis
*Assistant Examiner* — Chi Nguyen
(74) *Attorney, Agent, or Firm* — Alix, Yale & Ristas, LLP

(57) ABSTRACT

A window frame surrounds a window box in a wall having horizontally extending siding elements that are connected along overlapping horizontal seams and unconnected edges that are juxtaposed with the window box. The window box has top, bottom, and opposed side elements connected together to define a rectangle, wherein the top element has a transverse outer edge. The window frame has top, bottom, and opposed side frame elements connected together to define a rectangular frame, each element having front and back faces and inner and outer edges whereby the back faces of the window frame elements cover the unconnected edges of the siding and the inner edges of the frame elements closely surround the elements of the window box. A rigid strip is attached to the inner edge of the top element of the window frame and projects over and is vertically supported by the outer edge of the top element of the window box. A "J" hook is attached to the back of each side element of the window frame for engaging a seam in the siding.

12 Claims, 5 Drawing Sheets

WINDOW FRAME WITH INSTALLATION HOOKS

BACKGROUND

The present invention relates to building construction and in particular to the framing of doors, windows, and other wall penetrations.

Many residential and some commercial buildings have a clapboard type siding of wood, aluminum, or vinyl, during construction or renovation, must be trimmed to accommodate a wall penetration where a window box or the like is to be mounted.

Typically, a frame is secured to the wall and surrounds the window box, to provide both a visual enhancement to the window as well as an interface for a clean transition with the siding that surrounds the wall penetration.

SUMMARY

The installation of such frames has proven to be quite tedious and the present invention has the object of simplifying the installation of such frames.

The invention is directed to a frame having certain innovative characteristics that facilitate such simplified installation as well as a frame that has been installed using such innovative features.

These innovative features include a rigid strip attached to the inner edge of the top element of the window frame, wide enough to project over and rest on the outer edge of the top element of the window box, and a hook attached to the back of each side element of the window frame for engaging the respective seams in the siding beneath the side elements of the window frame.

In this manner, the strip provides vertical support for the frame, whereas the hooks prevent the frame from pulling away from the siding.

In one aspect, the frame comprises a substantially rectangular body formed by opposed upright sides and a top and a bottom each spanning the sides, the top having an inner edge facing the bottom. A rigid strip is attached to the inner edge of the top having a width transverse to the inner edge that projects from the back of the body. A hook is attached to the back of each side of the body, each hook having a substantially vertical end portion spaced from the back of the respective side. In this manner, both the strip and the hook project from the back of the body, for engaging the top of the window box and seams in the siding, respectively.

In another aspect, a window frame surrounds a window box in a wall having siding elements that are connecting along overlapping horizontal seams and unconnected edges that are juxtaposed with the window box. The window frame has top, bottom and side frame elements connected together to define a rectangular frame, each element having front and back faces and inner and outer edges whereby the back faces of the window frame elements cover the unconnected edges of the siding and the inner edges of the frame edges closely surround the window box. A rigid strip attached to the inner edge of the top element of the window frame projects over and is vertically supported by the outer edge of the top of the window box. A hook attached to the back of each side element of the window frame engages a seam in the siding. In this manner, the strip vertically supports the frame, whereas the hooks prevent the frame from pulling out of the siding.

BRIEF DESCRIPTION OF THE DRAWING

The preferred embodiment of the invention will be described with reference to the accompanying drawing, in which.

DETAILED DESCRIPTION

Figure 1:
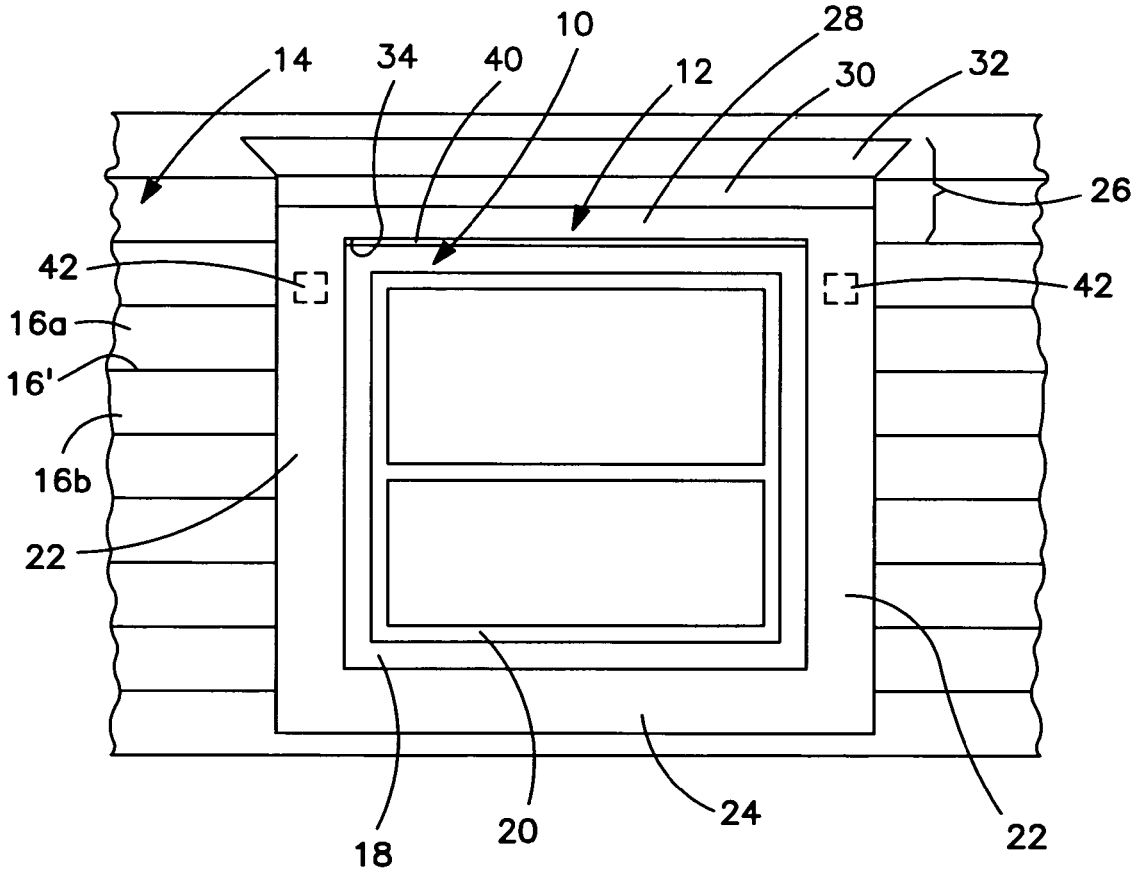
FIG. 1 is an elevation view of an installed window frame according to the invention.

FIG. 1 shows a window box 10 surrounded by a window frame 12 with surrounding siding 14 in a typical installation according to the present invention. It should be appreciated that, although the illustrated embodiment is for a window frame, the invention can be utilized for other wall penetrations such as doors, ventilators, etc. The term "window frame" or "frame" should be understood as covering all such variations.

The siding 14 is formed by overlapping, individual siding elements such as 16(*a*), 16(*b*) each having upper and lower edges that overlap in known manner to secure each element to an adjacent element, along a seam 16'.

The window box 10 typically has a rectangular box 18 formed from top, bottom and side elements connected together, for supporting the window 20, which may or may not have moveable glass panels.

The window frame 12 has opposed side elements 22, a bottom element 24 and a top or head element 26. The inner edges of the frame 12 closely conform with the outer edges of the box 10. As will be described in greater detail below, the siding has side edges that are juxtaposed with the outer edges or perimeter of the side elements of the window box, and the longitudinal edges of the siding may also be close to the outer edges of the top and bottom elements of the window box, but in the installed condition of the frame as shown in FIG. 1, these edges are covered by the frame thereby providing a neat, clean appearance.

Figure 2:
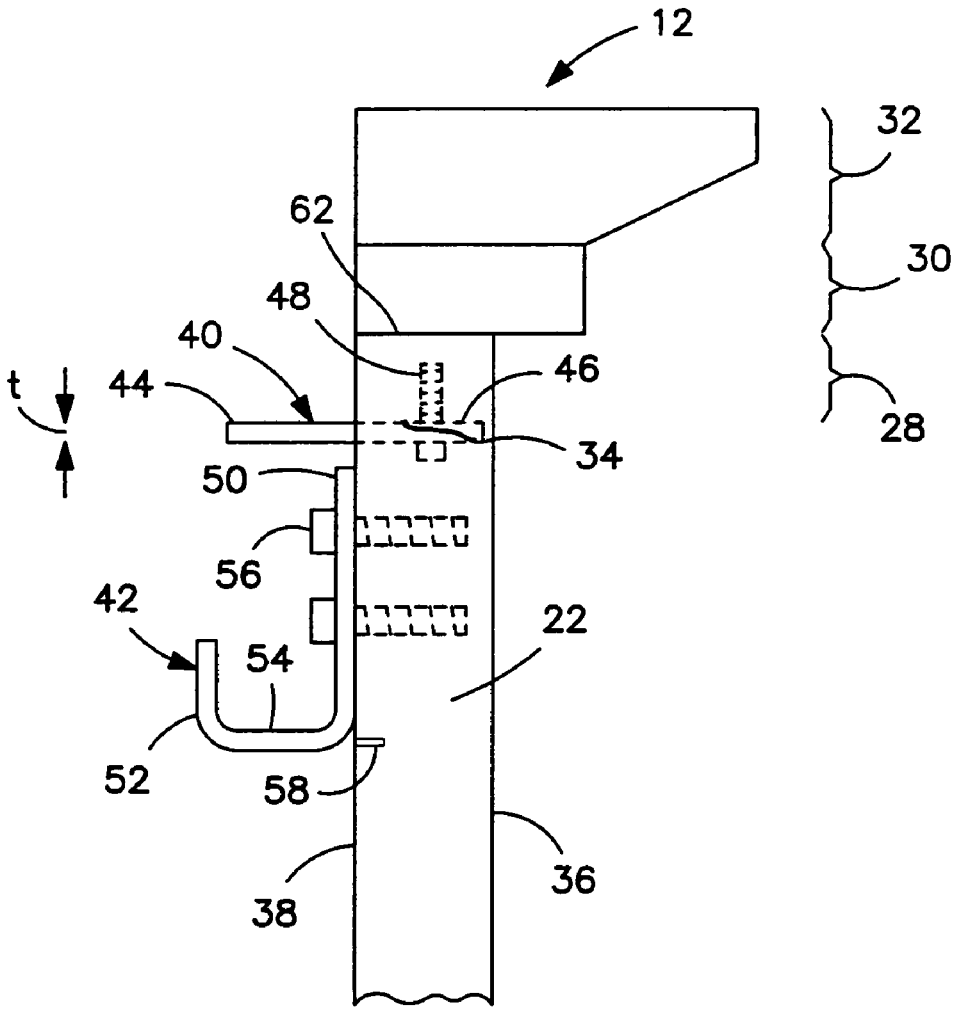
FIG. 2 is a side elevation view of the window frame prior to installation.

The top element 26 of the frame may have a more ornamental structure than the side elements. For example, the side and bottom elements are typically flat boards and likewise the portion 28 of the head 26 closest to the window box 10 is also a flat board which may be the same or different width relative to the side and bottom elements. The inner edge 34 of the top element 26 plays a significant role in the present invention as will be described in greater detail below. As shown in FIG. 2, the top 26 may have an additional projecting board 30 and a cornice or the like 32, both of which project to varying degrees from the front face of the frame.

In one implementation of the invention, the frame 12 is prefabricated for delivery to a job site, where the building contractor has measured the relationship between the window box 10 and the siding 14. In an alternative, as will be described, the window frame manufacturer delivers the window frame with the associated attachment hardware either as loose components with the window frame, or loosely assembled to the window frame.

With the prefabricated frame as shown in FIG. 2, the side element 22 has a front face 36 and a back face 38 which define a thickness. The inner edge of base portion 22 of the top element has an inner edge 34 (which is hidden and shown in phantom in FIG. 2). A rigid strip 40, such as aluminum or steel is situated transversely at the inner edge 34 and preferably extends the full length of the inner edge 34 as shown in FIG. 1. The strip 40 has a width transverse to the length of edge 34 such that the strip has an inner portion 44 that projects from the back side of the back side 38 of frame element 22, and an inner portion 46 that is attachable via screws or the like 48 against the inner edge 34.

The hook 42 preferably has the overall shape of a squared-off "J" including a flat base portion 50 and a substantially vertical end portion 52 spaced from the back 38 of the side element 22. A web portion 54 connects the base 50 and upright end portion 52. The two screws or the like 56 are driven through respective holes in the base 50 for a secure attachment to the side elements 22 of the frame.

It should be appreciated that as shown in FIG. 1, in the installed condition, the projecting portion 44 of the strip 40 rests on the outer edge of the top element of the window box 10, and thereby provides vertical support to the frame. In a manner to be described more fully below, the hooks 42 on the side elements 22 engage the seams of the overlapping siding elements.

Figure 3:
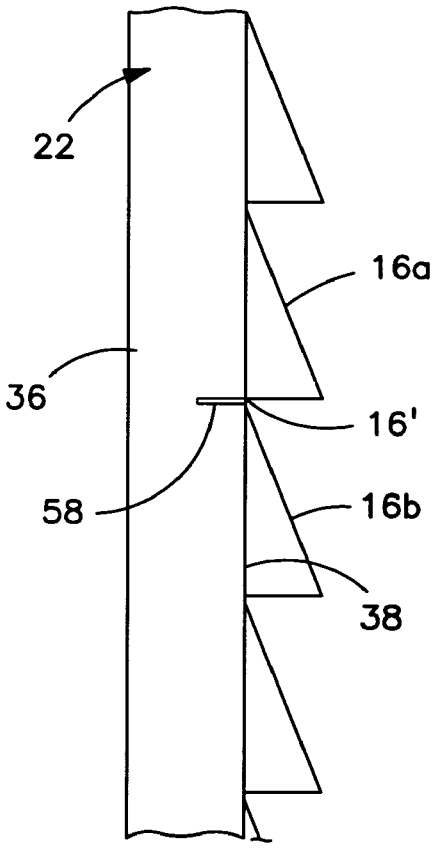
FIG. 3 is a side elevation view of the window frame against the wall siding during the step of measuring for locating the hooks on the back side of the frame.
Figure 4:
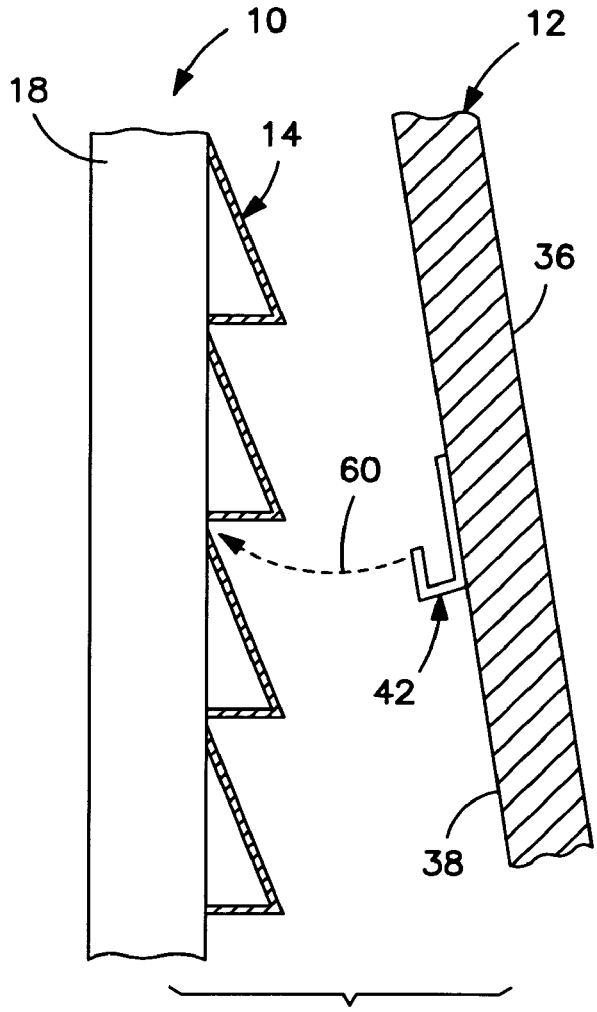
FIG. 4 is a side elevation view, partly in section, of the frame during installation whereby the hooks engage the seams on the siding.

With the prefabricated option, the contractor receives the frame 12 as depicted in FIG. 2 but unscrews and removes the strip 40. The hooks 42 remain in place, but it should be appreciated that the bottom of the hook is aligned with a particular location 58 on the frame element 22 which location, shown in FIG. 3, corresponds to a seam 16 as shown in FIG. 3. With the strip removed, the frame 12 is located around the window box 10 and angled relative thereto as shown in FIG. 4. FIG. 4 shows an outer edge of the side element 18 of the window box, recessed with respect to the plane of the paper, where the vertical section is taken through the siding and the window frame 12. Thus, the frame 12, hook 42, and portion of the siding shown in section are closer to the observer than the side element 18 of the window box whereby the frame 12 can be pivoted in the manner shown by the dashed line 60 such that the hook engages the seam 16' between two siding elements. While the hook is engaged with the seam, the top element 28 of the frame is pushed into place as shown in FIG. 1. The strip 40 is then inserted along the inner edge 34 of the top element such that the projection 34 overlays the top edge of the window box. While the frame is held in this position, the installer drives the screws 48 or equivalent fasteners through the strip into the top element. After the plurality of screws have been inserted along the inner edge 34, the operator steps back and has completed the installation.

It should be appreciated that the plate 40 is not present during the engagement of the hook 42 with the siding seam 16' because the frame must have the freedom to move vertically to effectuate this engagement. Only after the hooks 42 have been engaged, at which point the inner edge 34 of the top element is at a slightly higher elevation and forms a gap with the outer edge of the window box, can the strip 40 be inserted and attached as described above.

In an alternative technique where the hardware is provided separately from the frame, the installer would first place the window frame on top of the window box, against the siding, and slide the aluminum strip 40 between the inner edge of the top element and the outer edge of the top element of the window box, but not fasten the strip. With the strip temporarily in place, the installer would, as shown in FIG. 3, place a mark 58 on the frame at a location corresponding to a seam 16'. Thereafter, the J-hooks would be attached as shown in FIG. 2, with the bottom of the J-hook (i.e., bottom of the web) aligned with the mark 58. The strip 40 would then be removed from its temporary insertion between the window frame and the window box. The window frame would be positioned slightly below the window box at an angle, such as shown in FIG. 4, and moved along line 60 until the hook is pressed against the siding whereupon the frame and hook are pushed upwardly to engage the seam. When the frame is thus in the proper position, the strip is then reinserted and then screwed into place as is shown in FIG. 2. It should be appreciated that more than one hook could be attached to each side element 22.

One of ordinary skill in the art can readily adapt the foregoing techniques to the particular type of window box end frame to be installed. In general, however, as viewed in FIG. 2, the strip 40 would have a thickness "t" that is considerably smaller than the width of the top element 26 of the frame, and in particular, even with an ornamental configuration such as shown in FIG. 2, the width "t" of the strip is smaller than the width of the base 28 of the top element (i.e., the distance between the inner 34 and outer 62 edges of the base 28). The base of the J-hook preferably has a length in the range of about 2-3 inches, with the end portion extending vertically from the web 54 a distance in the range of about ¼ to 1 inch, with spacing from the back side 38 of the side element, in the range of about ½ to 1 inch.

As viewed from the front (shown in phantom at 42 in FIG. 1) the J-hooks preferably are uniform width transversely to the side element (i.e. the base, web and end portion have a width in the range of about 1-3 inches. In general, the thickness "t" of the strip 40 is in the range of ⅛ to ¼ inch, depending on the strength needed for supporting the weight of the frame vertically, and the tolerance between the elevation of the inner edge of the top element of the frame and the outer edge of the top element of the window box.

Figure 5:
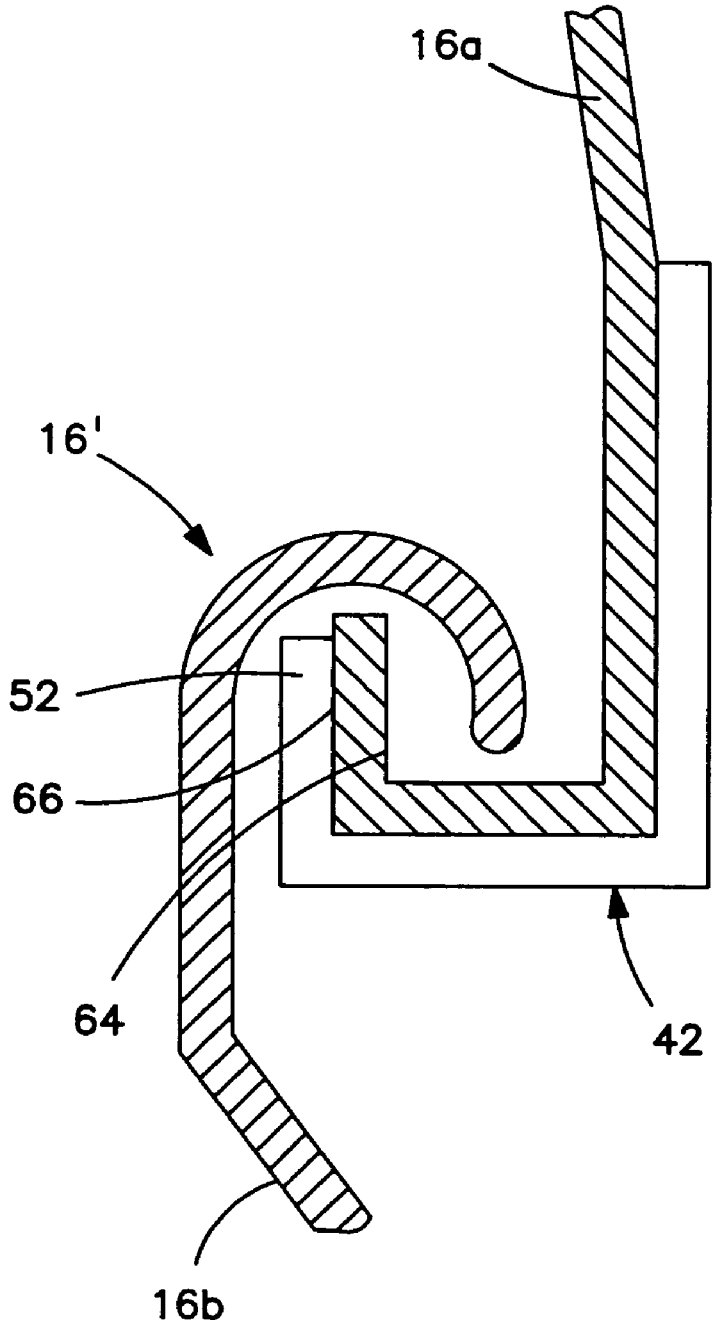
FIG. 5 is a section view of the strip providing vertical support against the window box in the installed condition.

FIG. 5 shows the details of the way in which the end portion 52 of the J-hook 42 engages the seam 16' between two siding elements 16(*a*), 16(*b*). The lower edge of an upper element in conventional siding installations includes an upwardly curved J-channel 64 or the like which includes an outer surface 66 that acts as a stop for the end portion 52 of the J-hook, preventing the hook (and the frame attached thereto as shown in FIG. 2) from pulling away from the siding.

Figure 6:
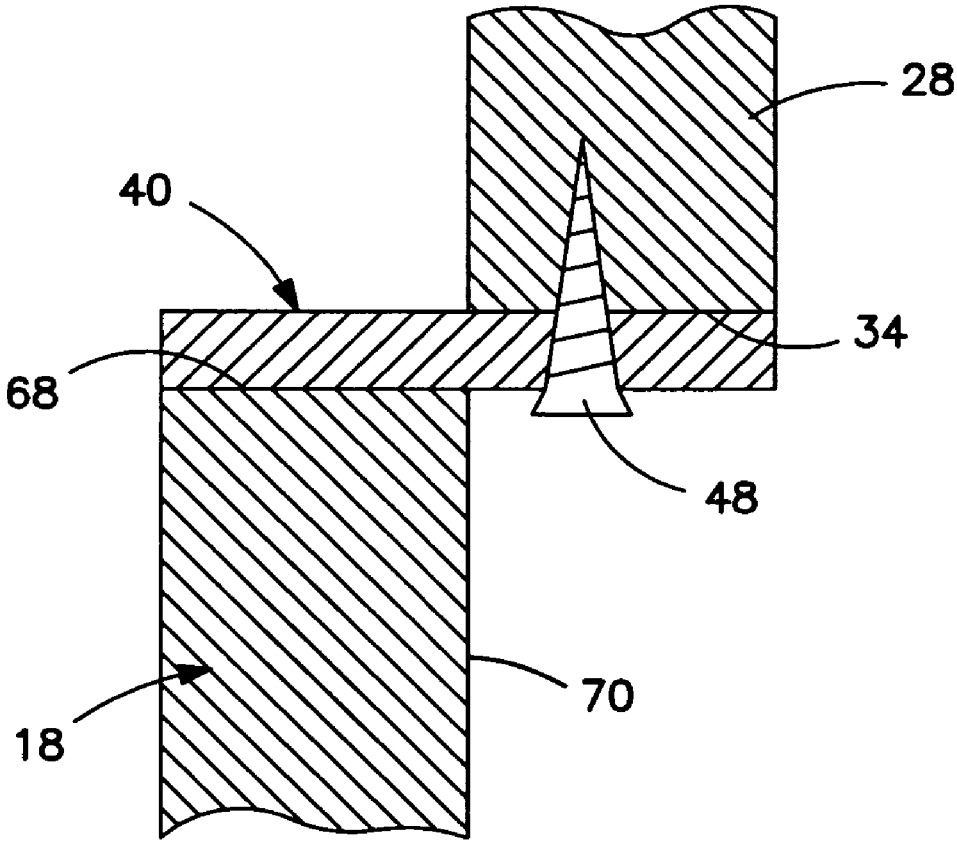
FIG. 6 is a section view showing the engagement of the hooks into the siding seam after installation.

FIG. 6 is a section view of the region of the installed strip 40 between the lower edge 34 of the base portion 28 of the top element of the frame, and the outer edge 68 of the top element 70 of the window box.

What is claimed is:

1. A window frame comprising:

a substantially rectangular body having a thickness defined between a front and a back and formed by opposed upright sides, and a top and a bottom each spanning the sides, the top having an inner edge of said thickness facing the bottom;

a rigid strip attached to the inner edge of the top, having a width transverse to said inner edge that projects from the back of the body; and a distinct hook attached respectively to the back of each side of the body and hidden from frontal view by the front of the respective side;

wherein each distinct hook is a J-hook having a base attached to the back of a respective side, a web projecting horizontally from the base, a substantially vertical end portion extending from the web and spaced from the back of the respective side.

2. The window frame of claim 1, wherein the top has a width on the front between an outer and said inner edge, and said strip has a thickness parallel to said front, that is smaller than the width of the top.

3. The window frame of claim 2, wherein the strip is metal.

4. The window frame of claim 1, wherein the vertical end portion of each hook extends vertically in the range of about ¼ to 1 inch, and is spaced from the back of a respective side a distance in the range of about ½ to 1 inch.

5. The window frame of claim 1, wherein the base of each J hook has a length in the range of about 2-3 inches, the end portion extends vertically from the web a distance in the range of about ¼ to 1 inch, and is spaced from the back of a respective side a distance in the range of about ½ to 1 inch.

6. The window frame of claim 5, wherein the base, web, and end portion all have a width transverse to the side, in the range of about 1 to 3 inches.

7. The window frame of claim 1, wherein the top has a width on the front between an outer and said inner edge, and said strip is metal having a thickness parallel to said front, that is in the range of about ⅛ to ¼ inch;

the hooks are J hooks having an elongated flat base attached to a respective side, a horizontally projecting web, and the vertical end portion extends from the web a vertical distance at least twice the thickness of the strip.

8. The window frame of claim 7, wherein the base of each J hook has a length in the range of about 2-3 inches, the end portion is spaced from the back of a respective side a distance in the range of about ½ to 1inch, and the base, web, and end portion all have a width transverse to said respective side, in the range of about 1 to 3 inches.

9. A window frame surrounding a window box in a wall having horizontally extending siding elements that are connected along overlapping horizontal seams and unconnected edges that are juxtaposed with the window box, comprising:

a window box having top, bottom, and opposed side elements connected together to define a rectangle, wherein said top element has a transverse outer edge;

a window frame having top, bottom, and opposed side frame elements connected together to define a rectangular frame, each frame element having front and back faces and inner and outer edges whereby the back faces of the frame elements cover said unconnected edges of the siding and the inner edges of the frame elements closely surround the elements of the window box;

a rigid strip attached to the inner edge of the top element of the window frame and projecting over and vertically supported by the outer edge of the top element of the window box; and a distinct hook attached respectively to the back of each side element of the window frame, each hook engaging a seam in the siding.

10. The window frame of claim 9, wherein each hook has a substantially vertical end portion spaced from the back of the respective side element.

11. The window frame of claim 10, wherein said strip is metal having a thickness parallel to said front face of the top frame element, that is in the range of about ⅛ to ½ inch; and each hook is a J hook, each hook having an elongated flat base attached to a respective side element of the frame, a horizontally projecting web, and the vertical end portion extends from the web a vertical distance at least twice thickness of the strip.

12. The window frame of claim 11, wherein the base of each J hook has a length in the range of about 2-3 inches, the end portion is spaced from the back of a respective side element a distance in the range of about ½ to 1 inch, and the base, web, and end portion all have a width transverse to said respective side, in the range of about 1 to 3 inches.

* * * * *